United States Patent [19]

Donnez

[11] Patent Number: 4,967,703

[45] Date of Patent: Nov. 6, 1990

[54] MACHINE HAVING ROTARY RECIPROCATING PISTON

[76] Inventor: Marc Donnez, 73b Avenue de le Libération, B-1640 Rhode St. Genése, Belgium

[21] Appl. No.: 376,702

[22] Filed: Jul. 7, 1989

[30] Foreign Application Priority Data

Jul. 11, 1988 [BE] Belgium ..... 08800795

[51] Int. Cl.[5] ..... F02B 53/00

[52] U.S. Cl. ..... 123/45 R; 417/375; 417/461

[58] Field of Search ..... 123/45 A, 45 R; 60/201, 60/39.78; 92/57, 173; 417/375, 461

[56] References Cited

U.S. PATENT DOCUMENTS

| | | | |
|---|---|---|---|
| 1,239,728 | 9/1917 | Schleppy | 123/45 R |
| 3,893,433 | 7/1975 | Demetrescu | 123/45 A |
| 3,994,632 | 11/1976 | Schreiber | 123/45 A |
| 4,180,028 | 12/1979 | Richter | 123/45 A |
| 4,366,784 | 1/1983 | Paul | 123/45 A |

FOREIGN PATENT DOCUMENTS

| | | | |
|---|---|---|---|
| 2403099 | 7/1975 | Fed. Rep. of Germany | 123/45 A |
| 2580032 | 10/1986 | France | 123/45 R |
| 340939 | 2/1936 | Italy | 123/45 R |

*Primary Examiner*—David A. Okonsky
*Attorney, Agent, or Firm*—Fishman, Dionne & Cantor

[57] ABSTRACT

A rotary machine capable of functioning as a receiving machine or as a generating machine and comprising, in addition to the conventional control members, at least one cylinder and one piston moving in the said cylinder, the said piston having a shaft or a coaxial rod, wherein the head of the piston and the cylinder head have a relief matched to one another and arranged in such a way that the rotational movement of the piston relative to the cylinder is induced as soon as a pressure occurs in the chamber of the said machine contained between the cylinder, its cylinder head and the piston.

11 Claims, 10 Drawing Sheets

MACHINE HAVING ROTARY RECIPROCATING PISTON

OBJECT OF THE INVENTION

The present invention relates to a rotary machine capable of functioning as a receiving machine, such as a pump, compressor or the like, or as a generating machine, such as a steam engine, hydraulic motor, internal-combustion or external-combustion engine or the like. It relates more particularly to a rotary machine comprising at least one cylinder and one piston moving in the latter and converting the reciprocating movement of the piston into a rotary movement of this, or vice versa.

STATE OF THE ART

There are several known machines comprising at least one cylinder and one piston moving in the said cylinder, the said piston comprising a shaft or a coaxial rod and converting the reciprocating movement of the piston into a rotary movement of the shaft, or vice versa, depending on whether the machine is working as a generating or a receiving machine.

Thus, Patent Application No. PCT/AU86/00031 (WO86/ 04637) relates to a machine of the abovementioned type, in which the rotary movement is imparted by rollers or the like integral with the piston and guided on a corresponding path, the pistons being integral in terms of rotation with the drive shaft.

The documents US-A-2,347,364, US-A-2,316,394, US-A-1,629,686, US-A-2,288,480, US-A-1,389,453, GB-A-1,563,498, GB-A-1,450,815, GB-A-304,701, FR-A-730,941,FR-A-652,281, FR-A-514,067, DE-A-1,954,631, DE-C-513,891, DE-A-3,247,442, GB-A-479,727, US-A-4,366,784 and EP-A-65,068 also relate to similar mechanisms, such as rollers, balls or the like, which move on surfaces, grooves or rails of a helical profile, in order to generate a rotational movement during the axial to-and-fro movement. However, these various solutions have sources of friction and high wear and usually employ complex mechanisms which are consequently expensive and difficult to adjust.

OBJECTS OF THE INVENTION

The object of the present invention is to provide a rotary machine of the abovementioned type which makes it possible to avoid the disadvantages of the machines according to the state of the art.

An additional object of the present invention is to provide a machine of the abovementioned type which does not employ a complex linkage and which functions with a smaller number of moving parts, generating reduced mechanical stresses in the arrangement.

ESSENTIAL ELEMENTS OF THE INVENTION

According to the present invention, the rotary machine capable of functioning as a receiving machine or as a generating machine comprises, in addition to the conventional control members, at least one cylinder and one piston moving relative to the said cylinder. It is characterized more particularly in that the head of the piston and the cylinder head have a relief matched to one another and arranged in such a way that the rotational movement of the piston relative to the cylinder is induced as soon as a pressure occurs in the chamber of the said machine contained between the cylinder, its cylinder head and the piston.

This results in a device which converts a reciprocating movement into a rotary movement, or vice versa, and which is composed of few moving parts and generates few mechanical stresses and therefore little wear.

According to a first alternative version, the piston is made integral at least in terms of rotation with a shaft or a coaxial rod transmitting the rotational movement.

According to another alternative version, the piston is stationary at least in terms of rotation and the cylinder is free in terms of rotation relative to the said piston and serves for transmitting the rotational movement.

The rotational movement is obtained as a result of the interaction of the piston head and cylinder head in the compression phase. Advantageously, the piston is designed in such a way that its surface has a wave-shaped, sinusoidal or such like profile arranged, for example, radially in relation to the axis of the cylinder. The cylinder head has a profile which is converse to that of the piston and where the protuberances are placed by recesses, and vice versa. At the location called the "bottom dead center", the surfaces of the piston and cylinder head have an angular offset and their respective forms are therefore designed so that, in the so-called "top dead center" position, the two surfaces coincide once the piston has been subject to rotation through a fraction of a revolution. The number of sinusoids of the piston surface is a function of the fraction of a piston revolution to be obtained during the compression time.

Of course, the machine according to the present invention can function as an engine, for example a two-stroke or four-stroke internal-combustion engine with self-ignition (Diesel engine) or with controlled ignition, or a fluid motor (air, steam, hydraulic, etc.), or as a pump.

Bearing in mind that the above description does not mention the members for the control of ignition, intake and exhaust (valves), it should be noted that the rotary machine according to the invention has a smaller overall size in relation to the state of the art because of its simplicity and its few moving parts. This also results in a less expensive construction and easy maintenance.

According to a first alternative embodiment, the rotary machine according to the present invention comprises a piston which moves relative to a cylinder, the return force of the piston being supplied by a spring.

According to another alternative embodiment, the rotary machine according to the present invention comprises a pair of opposing integral pistons moving relative to one and the same cylinder equipped with two cylinder heads, each matched to the corresponding piston.

Alternatively, it is also possible to connect several cylinders and pistons to one another along a same axis, these having equal or different diameters.

It can be advantageous for the shaft to pass through the cylinder head or cylinder heads, the pistons being made integral, preferably in terms of rotation, with the shaft, for example by means of a non-circular section or a splined segment.

In the abovementioned embodiment, it is possible to protect the shaft in the cylinder or the combustion chamber by seating it in an extension of the piston serving as a protective sleeve for the shaft, the said extension of the piston being designed to execute a to-and-fro movement in a corresponding recess made in the cylinder head. This arrangement is especially suitable for internal-combustion engines, where the high temperatures generated can have an adverse influence on the surface state and mechanical resistance of the shaft.

According to another embodiment, the force couple is transmitted to or received from the shaft at a location situated between the two pistons and cylinders by means of a conventional gear. In this case, it is possible to avoid passing the shaft through the piston and the cylinder head and limit the provision of gaskets subjected to high stresses.

It is also possible to provide several pairs of pistons mounted so as to reduce the operating vibrations. Thus, they can be mounted in such a way that, for example, the movements are mutually opposed.

Advantageously, the various embodiments mentioned above can be equipped with a flywheel regulating the rotary movement.

The controls of the valves have hitherto been omitted. However, such a device can be mounted on the shaft, especially when the latter passes through the piston and cylinder head. In this case, according to the invention there is at least one cam which has at least one suitable profile and which is driven in rotation on the said shaft via a reducer and controls the intake and exhaust valve.

BRIEF DESCRIPTION OF THE DRAWINGS

The invention is described in more detail below by means of the accompanying diagrammatic drawings in which.

In the Figures, identical reference symbols represent identical or like elements.

DESCRIPTION OF PREFERRED EMBODIMENTS

Figure 1:
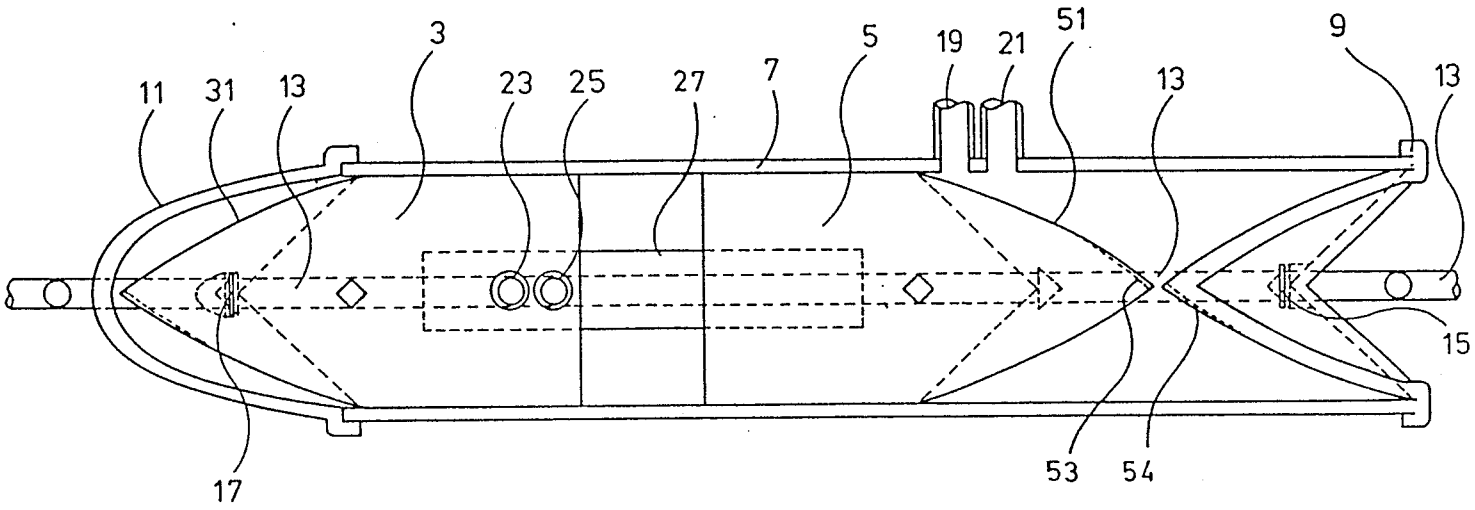
FIGS. 1 and 2 are diagrammatic representations in longitudinal section of a rotary machine according to the invention.
Figure 2:
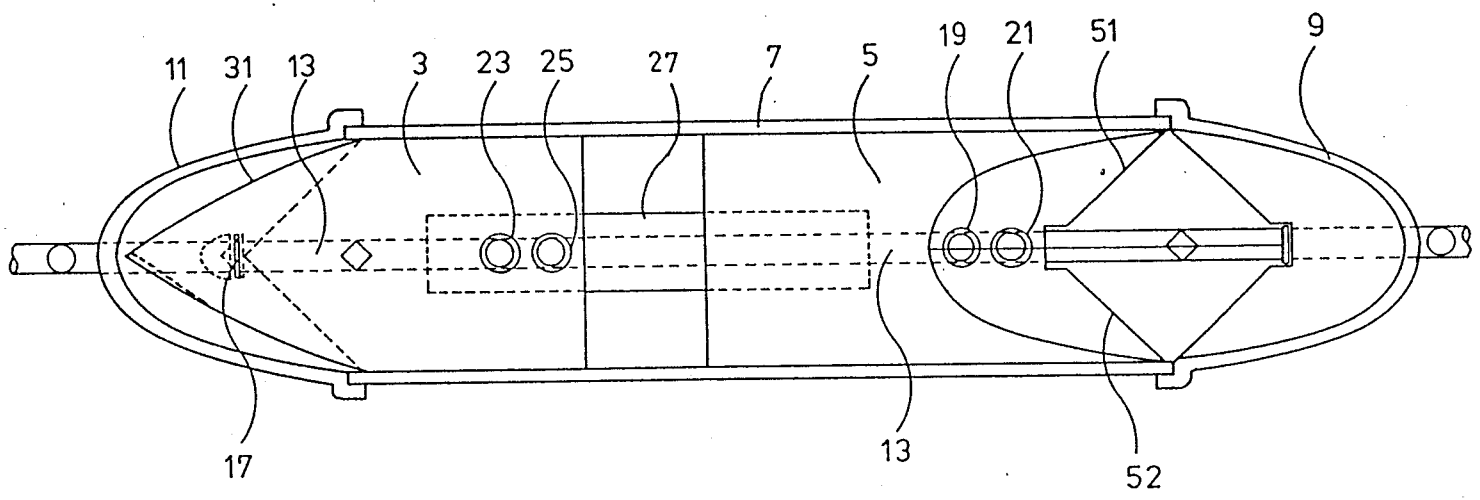

FIGS. 1 and 2 illustrate a rotary machine 1 according to the invention, in which two pistons 3 and 5 connected to one another and opposed to one another move in a common cylinder 7 equipped with a cylinder head 9 and 11 at each end.

The two pistons 3 and 5 are connected to one another by means of an intermediate piece 27 and are integral with a shaft 13 which passes through them and which also passes through the cylinder heads 9 and 11. The shaft is kept stationary in terms of translational movement by means of guards 15 and 17.

In the embodiment illustrated, the shaft 13 has a square cross-section at the location of passage through the pistons 3 and 5, for the purpose of transmitting the rotational movement of the pistons relative to the cylinder. Furthermore, at the location of passage of the shaft through the cylinder heads 9, 11, the cross-section of the said shaft is preferably circular.

In FIGS. 1 and 2, the pistons have a head profile with two peaks 31, 51 and 52 and the cylinder heads have matched forms. It is possible, of course, to provide a larger number of peaks according to the intended uses.

FIGS. 1 and 2 relate to a two-stroke diesel engine which is equipped with intake and exhaust ports 19 and 21 for the right-hand cylinder and 25, 23 for the left-hand cylinder.

FIG. 1 shows a machine in which the cylinder-head profiles are crossed, and FIG. 2 shows a machine in which the piston profiles are crossed.

When the piston 5 passes from the bottom dead center to the top dead center as a result of the expansion which occurs in the left-hand chamber, its peaks follow a sinusoidal or wave-shaped curve and thus impart this rotational movement to the piston which rotates through one quarter of a revolution. During the expansion in the right-hand chamber, the same phenomenon takes place in the left-hand chamber and the piston 5 is once again at bottom dead center, but offset 180°.

In fact, a slight asymmetry (53, 54) of the peaks of the pistons and cylinder head is sufficient to impart a rotational movement or a rotational impetus to the piston.

Theoretically, the profile of the peaks of the piston (P) and of the cylinder head (C) can be determined in the following way, on the assumption of an undulatory movement (see FIG. 3).

Case No. 1:

Constant state and theoretical piston of a zero mass (that is to say, capable of passing instantaneously from a zero speed to any constant speed).

It is easily determined that any point of the piston covers the distance 2nC (where C is the stroke of the piston and n the number of peaks) during the time necessary for it to execute a complete rotation, that is to say 2piR. Consequently, the theoretical path of each point of the piston is represented by a succession of slopes forming with the horizontal an angle theta, such that $$\tan \text{theta} = \frac{nC}{\text{pi}\, R}$$

Figure 3:
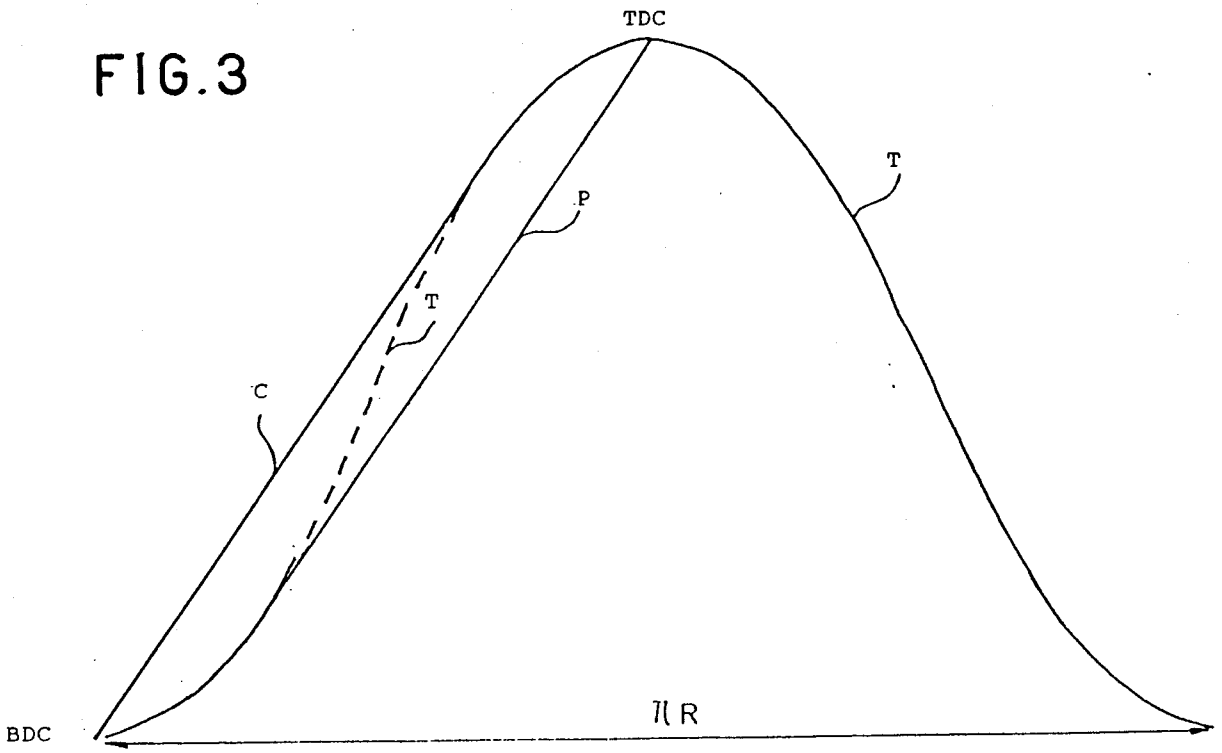
FIG. 3 shows a developed view of the piston and cylinder-head profiles.

If the bore (2R) is equal to the stroke (C), the equation is simplified to $$\tan \text{theta} = \frac{2n}{\text{pi}},$$

and the values of the angles are obtained as follows:

(a) for n=2 theta=51°51, (b) for n=3 theta=62°2,

The calculation thus made allows us to determine the position of the top dead center (TDC) and bottom dead center (BDC) for the head of a piston in a uniform reciprocating movement and in a uniform rotary movement (combined movements) (FIG. 3).

Case No. 2:

Constant state (rotation) and piston in a uniformly accelerated and uniformly decelerated reciprocating movement.

To determine the path of the points of the surface of the piston (more particularly the points on the periphery of the piston), a constant speed for covering the circumference 2piR and the equation $e=\frac{1}{2}$ gamma $t^2$ for determining the position of the point in its reciprocating movement, e being the space and gamma being a constant, will be taken into account.

It was chosen to determine the form of the head of the piston (P) at the start of the path (T) established for any point located at the piston/cylinder interface. The outer profile of the piston (see FIG. 3) has as the high point the TDC of the path and a straight slope tangential to the curve of the uniformly accelerated/- decelerated movement and follows this curve as far as the BDC.

The overall surface of the piston head is determined by successions of straight lines which start from a point at the outer edge and pass through a point of convergence on the central axis of the cylinder (here, the point of convergence was chosen arbitrarily at mid-height; it is likewise arbitrary to determine the surface of the piston by a succession of straight lines) and are extended towards the outer point symmetrical relative to the axis of rotation.

For the surface of the cylinder head, a similar approach was adopted (see FIG. 3, curve C), and the profile at the start of the path (T) of any point of the piston at the cylinder/piston interface was determined. Here, however, the BDC is adopted as the starting point and a straight slope tangential to the curve of the uniformly decelerated or accelerated movement is followed beyond the tangent point, the profile following the curve of the uniformly decelerated or accelerated movement towards the TDC.

The overall surface of the cylinder head can be determined by a succession of straight lines which start from a point at the outer edge, pass through a point of convergence on the central axis (a point preferably selected in a same way as the piston profile) and are extended towards the outer point symmetrical relative to the axis of rotation.

Figure 4:
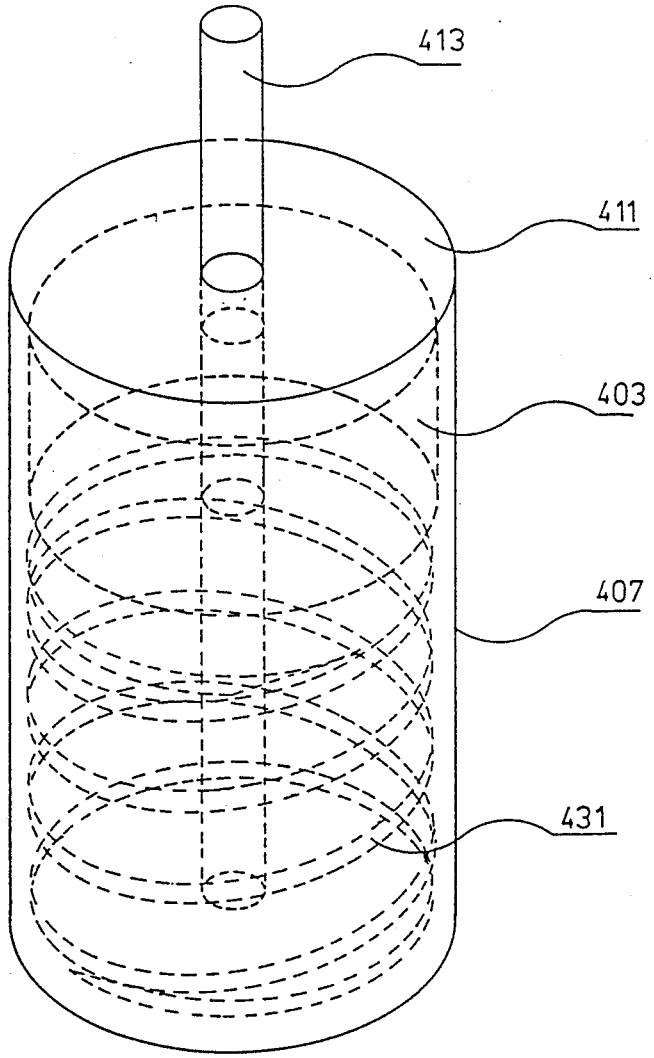
FIGS. 4 to 9 show special arrangements of the rotary machine according to the invention.

FIG. 4 shows diagrammatically, without taking into account the relief of the piston and of the cylinder head, a rotary machine according to the invention which has only a single piston 403 moving in a cylinder 407 equipped with a single cylinder head 411. The piston 403, after being brought from the TDC to the BDC under the effect of an expansion, is returned to the TDC under the effect of a spring force 431.

Figure 5:
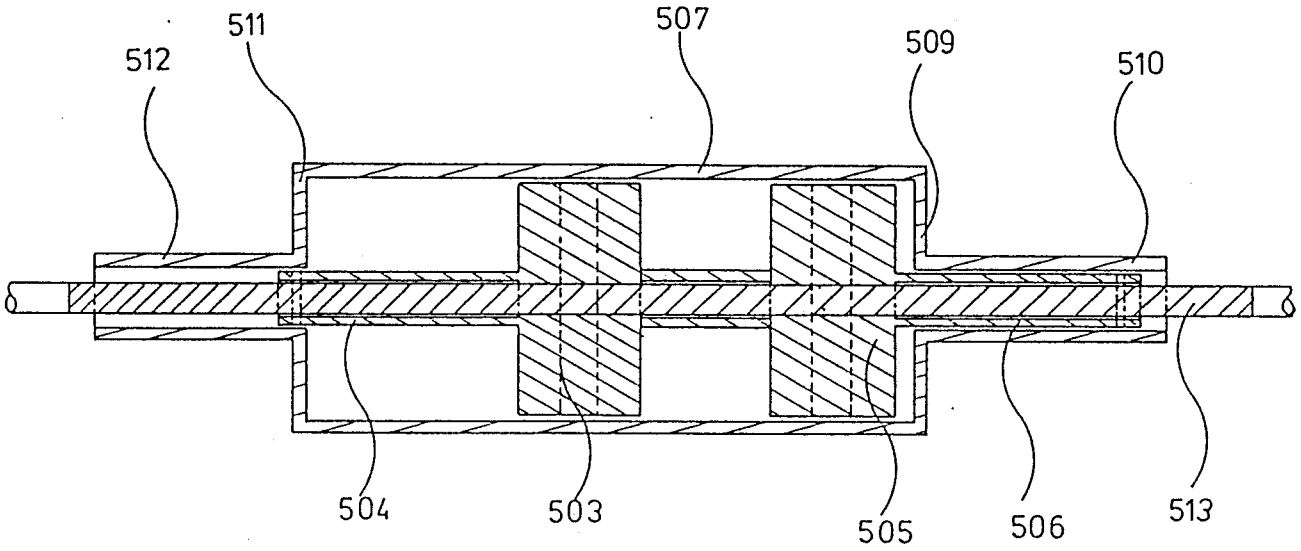

FIG. 5 illustrates an arrangement similar to that of FIGS. 1 and 2, in which the shaft 513 is protected by extensions 504, 506 of the pistons 503 and 505. The said extensions move beyond the cylinder heads 509 and 511 in corresponding recesses 510, 512 made in these.

Figure 6:
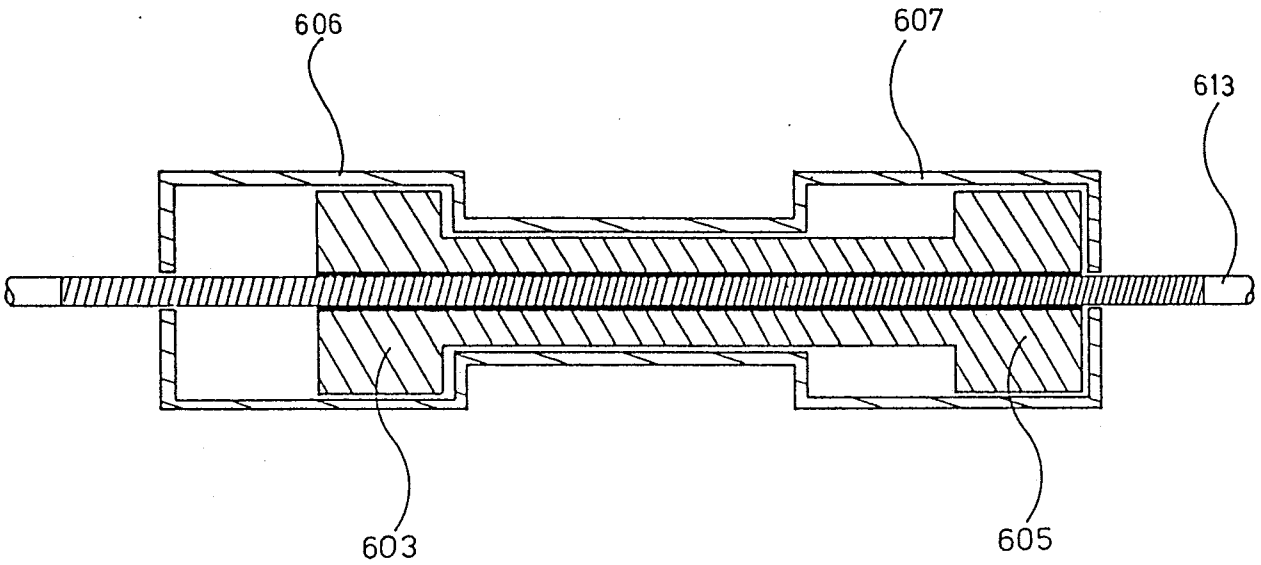

In FIG. 6, two pairs of pistons 603 and 605 move in two aligned cylinders 606 and 607. This configuration is especially suitable for the four-stroke cycle.

Figure 7:
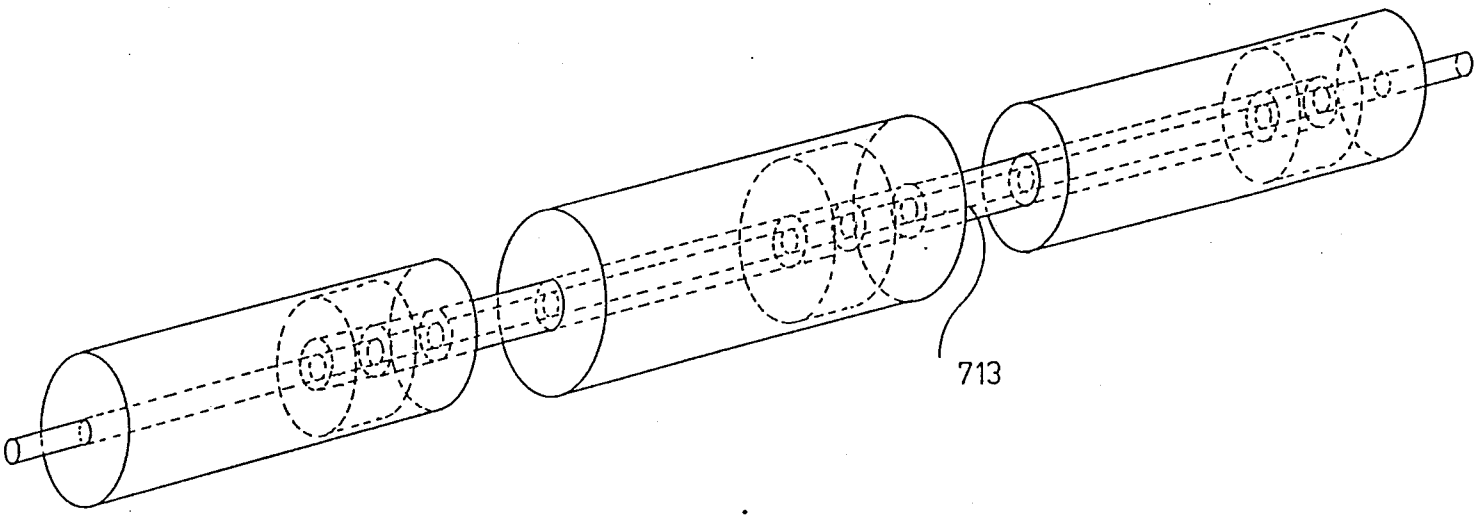

FIG. 7 is a diagrammatic representation of a possible coupling of several cylinders which, if appropriate, have different dimensions.

Figure 8:
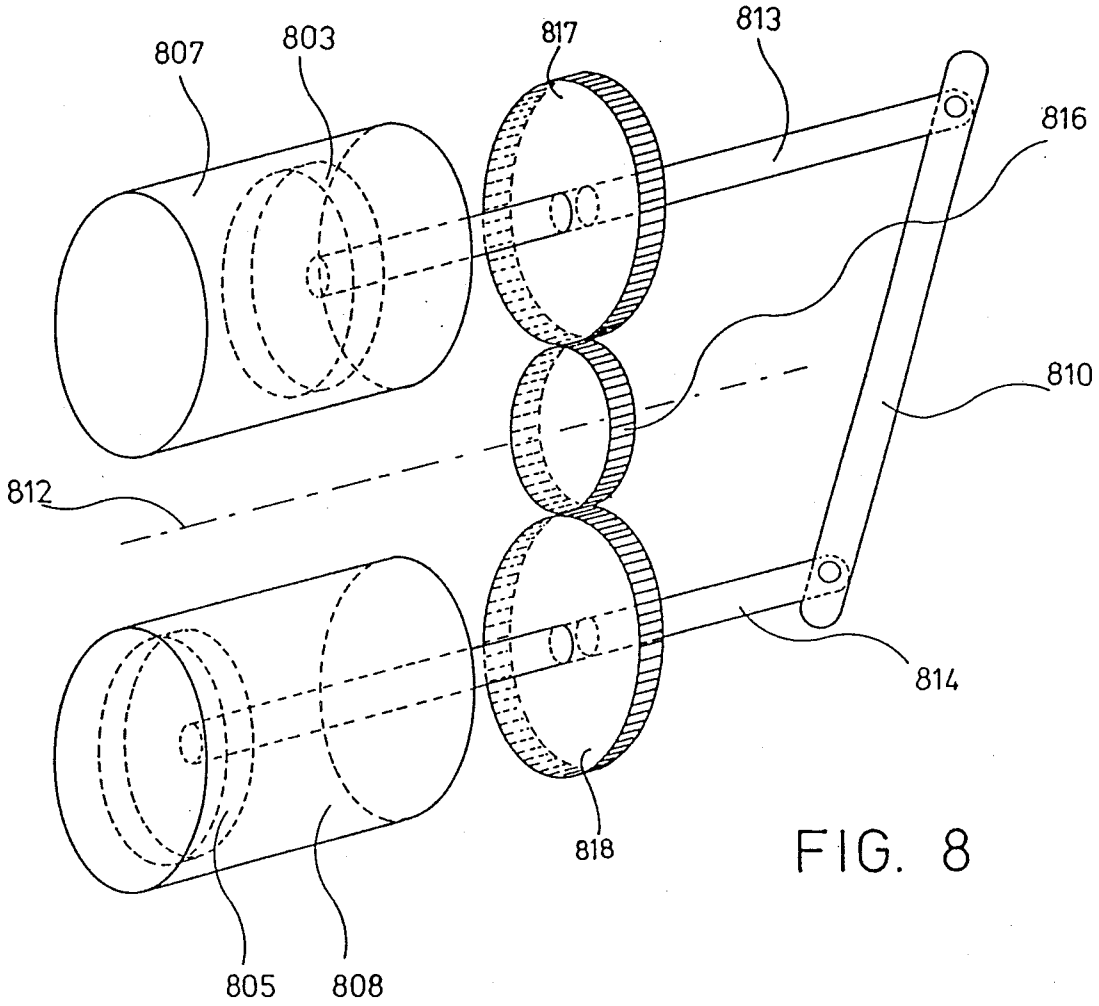

FIG. 8 illustrates another arrangement of a machine according to the present invention, in which two pistons 803 and 805 move in two essentially parallel cylinders 807 and 808, the two piston rods being connected by means of a rocker 810 which transmits the return force of one cylinder during the expansion phase to the other cylinder in the compression phase. A drive shaft 812 can be accommodated in such a way that the rotational movements of the piston rods 813 and 814 are transmitted to it in a suitable way via an appropriate gear 816, 817, 818.

Figure 9:
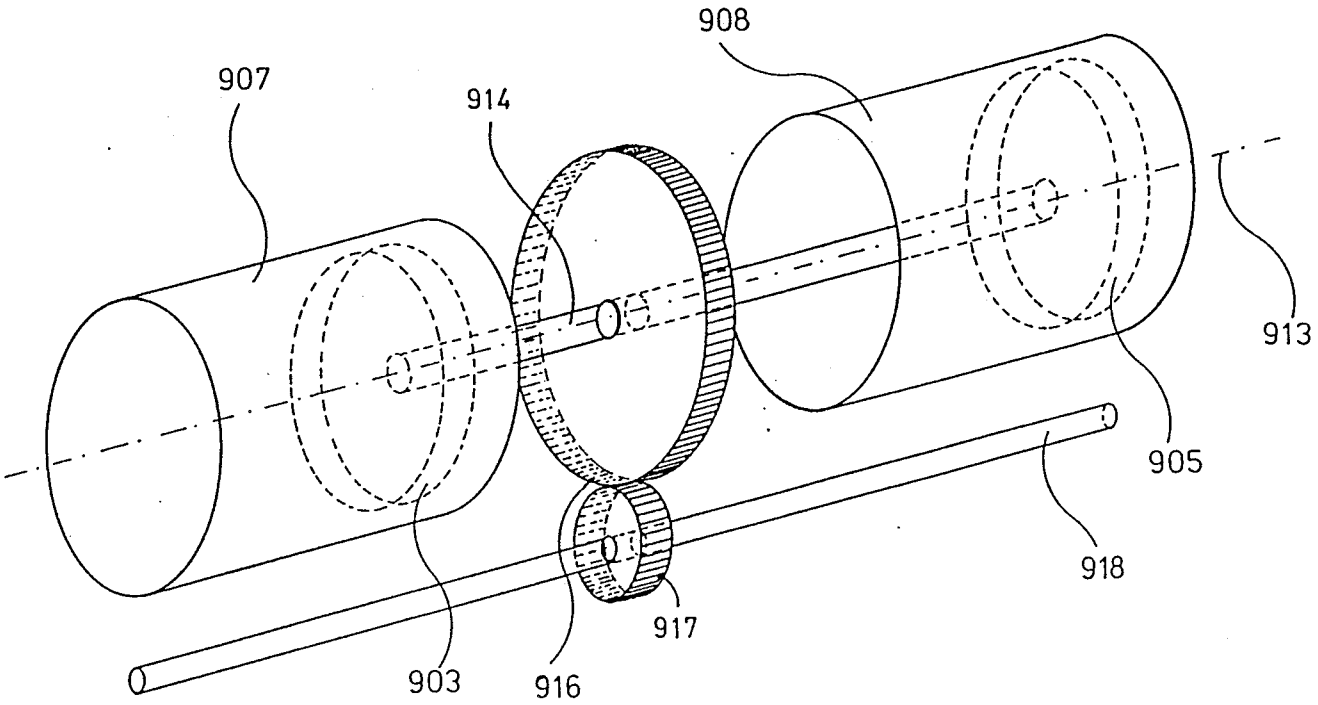

Another embodiment is illustrated in FIG. 9. Here, two cylinders 907 and 908 are mounted in opposition on a common shaft 913. The pistons 903 and 905 are connected to one another for the transmission of the reciprocating movement. Advantageously, the part 914 connecting the two pistons is equipped with a gear 916, 917 making it possible to transmit the rotational movement to a drive shaft 918. Preferably, the said gear 916 is connected in terms of rotation to the said part, without the to-and-fro reciprocating movement being transmitted.

Figure 10:
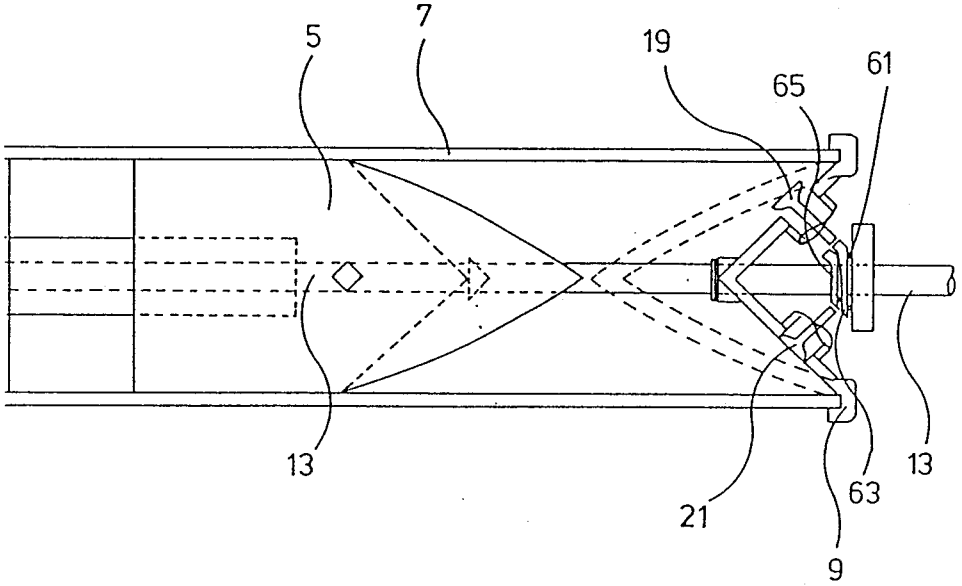
FIG. 10 is a diagrammatic view of the control of the intake and exhaust valves.

FIG. 10 shows a cam 61 having two suitable profiles 63 and 65 and connected in terms of rotation to the shaft 13, without thereby following the reciprocating movement, and which actuates the opening and closing of the intake and exhaust valves 19 and 21 as a function of the desired thermal cycle. According to an alternative version, the cam can be duplicated for the appropriate control of an opposing adjacent cylinder mounted on the same shaft 13.

The cams and valves have been shown diagrammatically. It is clear that it can be advantageous to modify their position or increase their number according to the desired performances.

It is clear that several cylinder/piston pairs can be connected to one another, whilst at the same time having different dimensions and/or functions.

Of course, the lubricating, cooling and sealing functions are performed within the scope of knowledge of an average person skilled in the art.

I claim:

1. A rotary machine, comprising:

a housing having a cylindrical bore, a first cylinder head attached to the housing at one end of the bore, said cylinder head having an inner surface and said inner surface having a profile; and a first piston slidably received within the cylindrical bore, said piston having a piston head surface and said piston head surface having a profile complimentary to the profile of the inner surface of the cylinder head;

wherein the housing, the inner surface of the cylinder head and the piston head surface define a chamber and the inner surface of the cylinder head and the piston head surface are complimentary profiled and oriented relative to each other so that pressurizing the chamber induces both axial movement and rotational movement of the piston relative to the housing.

2. The rotary machine of claim 1, wherein the inner surface of the cylinder head and the piston head surface each have a sinusoidal profile.

3. The rotary machine of claim 1, further comprising a piston rod for transmitting the rotational movement of the piston.

4. The rotary machine of claim 1, wherein the rotational movement is transmitted by rotation of the housing.

5. The rotary machine of claim 1, further comprising a spring urging the piston toward the cylinder head.

6. The rotary machine of claim 1, further comprising a second cylinder head opposite the first cylinder head said second cylinder head having an inner surface and said inner surface having a profile; and a second piston oriented opposite the first piston, said second piston having a piston head surface and said piston head surface having a profile complimentary to the profile of the inner surface of the second cylinder head;

a rod connecting the first and second pistons;

wherein the housing, inner surface of the second cylinder head, and the piston head surface of the second piston define a second chamber and the piston head surface of the second piston and the inner surface of the second cylinder head are oriented so that rotational movement of the piston relative to the housing is induced when the second chamber is pressurized.

7. The rotary machine of claim 3, wherein the rod passes through the cylinder head.

8. The rotary machine of claim 7, further comprising a recess in the cylinder head wherein the rod is slidably received in the recess.

9. The rotary machine of claim 3, further comprising:

means for transmitting forces from the rod to a drive shaft.

10. The rotary machine of claim 1, further comprising a flywheel for regulating the rotary movement of the piston.

11. The rotary machine of claim 7, further comprising:

valve means in the cylinder head; and a cam shaped lobe on the rod for operating the valve means.

* * * * *